US005937604A

United States Patent [19]

Bowron

[11] Patent Number: 5,937,604

[45] Date of Patent: Aug. 17, 1999

[54] CONCRETE FORM WALL SPACER

[76] Inventor: Robert F. Bowron, 11709 SE. Boise, Portland, Oreg. 97266

[21] Appl. No.: 09/137,582

[22] Filed: Aug. 21, 1998

[51] Int. Cl.[6] ..... E04G 17/06

[52] U.S. Cl. ..... 52/426; 52/442; 52/677; 52/715; 248/229.16

[58] Field of Search ..... 52/426, 427, 442, 52/677, 686, 687, 715; 248/63, 229.16, 229.26, 230.7, 316.7; 404/134, 135, 136

[56] References Cited

U.S. PATENT DOCUMENTS

| | | | |
|---|---|---|---|
| 1,863,115 | 6/1932 | Heltzel . | |
| 2,161,855 | 6/1939 | Copell | 248/316.7 |
| 3,154,281 | 10/1964 | Frank | 248/316.7 X |
| 4,496,264 | 1/1985 | Casey | 52/677 X |
| 4,884,382 | 12/1989 | Horobin | 52/426 |
| 5,216,866 | 6/1993 | Ekedal | 52/677 |
| 5,390,459 | 2/1995 | Mensen | 52/426 |
| 5,421,136 | 6/1995 | Van De Peer | 52/687 X |
| 5,459,971 | 10/1995 | Sparkman | 52/426 |
| 5,688,428 | 11/1997 | Maguire | 52/677 X |
| 5,782,050 | 7/1998 | Boeshart | 52/426 |

*Primary Examiner*—Carl D. Friedman
*Assistant Examiner*—Timothy B. Kong
*Attorney, Agent, or Firm*—Olson & Olson

[57] ABSTRACT

A concrete forms wall spacer is provided in the configuration of a truss having top and bottom horizontal frame members interconnected by angularly extending reinforcing struts. The top frame member is configured to rest upon the upper edges of a pair of spaced concrete form walls, and end portions of the top frame member are extended downward for abutment by the outer sides of the spaced concrete form walls, to define the desired spacing between the walls. Supported by the bottom frame member are a pair of spaced clip members each configured to removably support a pair of lengths of rebar which extend horizontally in opposite directions to other longitudinally spaced form wall spacers. A pair of vertically spaced rebar supports are mounted on the top and bottom frame members for frictionally securing a vertically extending length of rebar for forming a structural tie between a concrete footing and a vertically extending concrete wall. In a second embodiment of the invention, a plurality of pairs of vertically spaced rebar supports for vertical rebar are provided as detachable components.

12 Claims, 6 Drawing Sheets

CONCRETE FORM WALL SPACER

BACKGROUND OF THE INVENTION

This invention relates to concrete forms, and more particularly to a spacer for securing concrete form walls in predetermined spaced apart relation.

Concrete form wall spacers heretofore have been provided by structures of varying degrees of complexity. The simplest of these are 2×4 lumber or other wooden boards interposed between spaced concrete form walls and secured thereto by nails, staples, wire, etc. It is time consuming to instal and dismantle. A complex structural configuration of a concrete form wall spacer is described in U.S. Pat. No. 5,566,518 wherein spaced form walls are specially shaped to accommodate the attachment of correspondingly shaped components of a spacer. The specialized form walls and spacers are excessively costly.

SUMMARY OF THE INVENTION

The concrete form wall spacer of this invention includes a framework that spans the space between spaced concrete form walls of conventional materials and anchors the walls against end abutments on the framework, the framework also mounting rebar supports arranged to support lengths of rebar extending both horizontally through the concrete footing form and vertically upward through the concrete form and into a vertical concrete wall form for tying the footing and wall together.

It is the principal objective of this invention to provide a concrete form wall spacer that overcomes the disadvantages and limitations of prior spacers.

Another objective of this invention is the provision of a concrete form wall spacer of the class described that may be utilized with concrete forms of diverse conventional structural configurations.

Still another objective of this invention is to provide a concrete form wall spacer of the class described which also serves to support horizontally and vertically extended rebar.

A further objective of this invention is the provision of a concrete form wall spacer of the class described that is of simplified construction for economical manufacture.

The foregoing and other objects and advantages of this invention will appear from the following detailed description, taken in connection with the accompanying drawings of preferred embodiments.

DESCRIPTION OF THE PREFERRED EMBODIMENTS

Figures 1, 2:
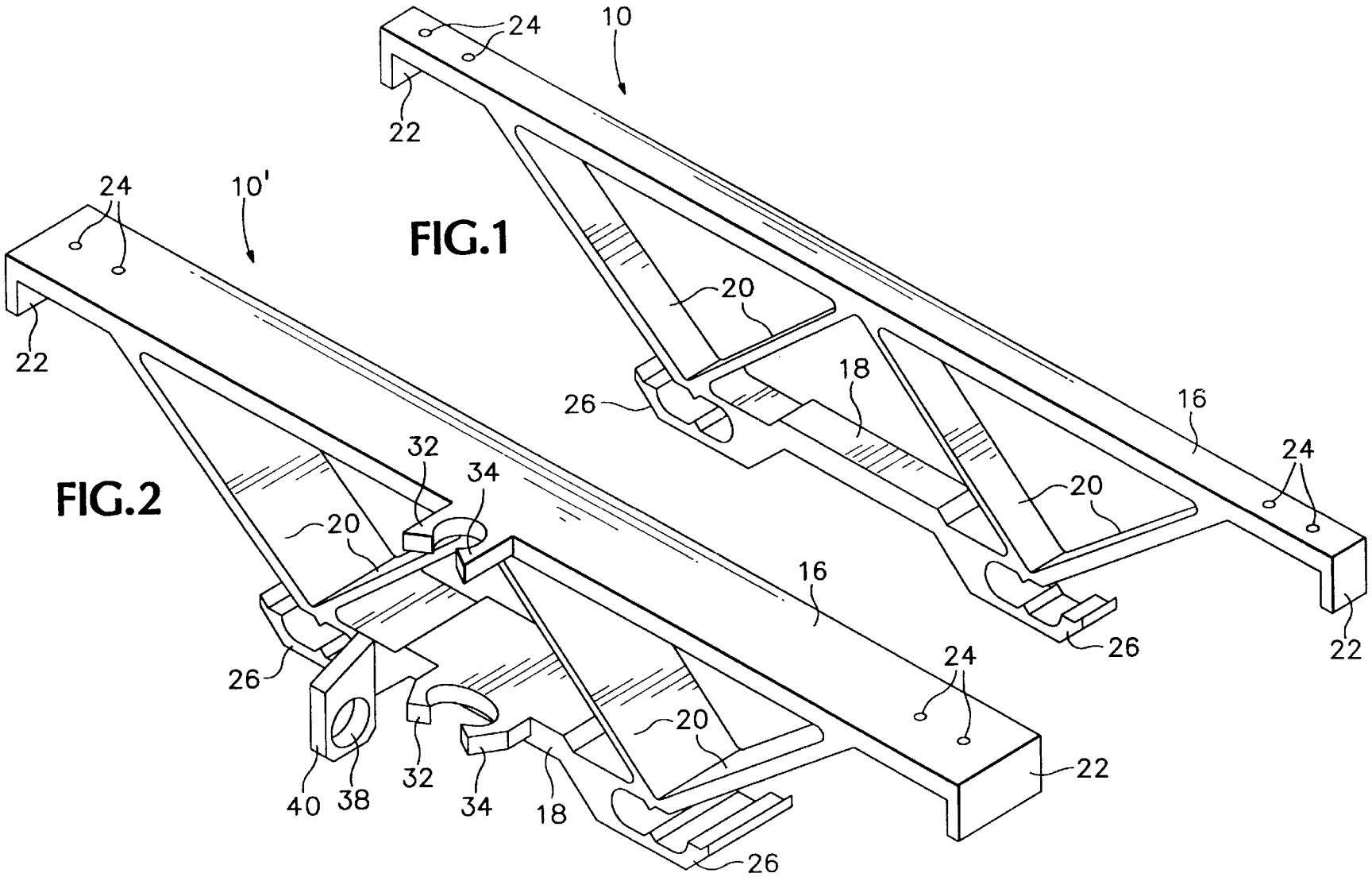
FIG. 1 is a perspective view of a concrete form wall spacer embodying the features of this invention.
FIG. 2 is a perspective view of a second embodiment of concrete form wall spacer embodying the features of this invention.
Figure 3:
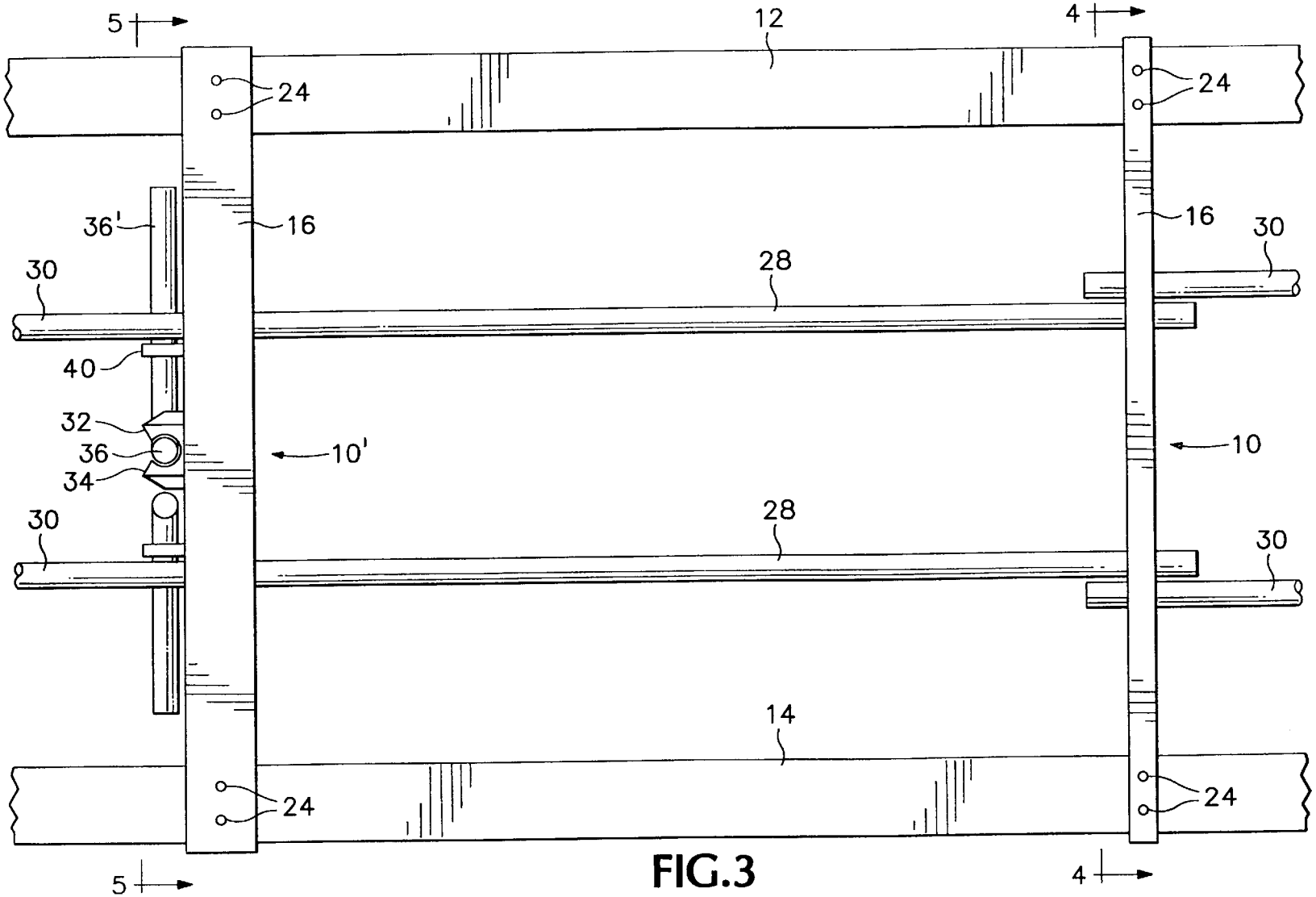
FIG. 3 is a fragmentary plan view of a concrete form wall assembly for a concrete footing and having associated therewith the concrete form wall spacers shown in FIGS. 1 and 2.

Referring principally to FIGS. 1 and 3 of the drawings, the concrete form wall spacers 10 and 10' illustrated serve to maintain a predetermined spacing between concrete form walls 12 and 14 defining a concrete footing of a building structure. The spacer 10 is in the form of a truss-type framework formed of top horizontal frame member 16 and bottom horizontal frame member 18 interconnected by angular reinforcing strut members 20.

Figure 4:
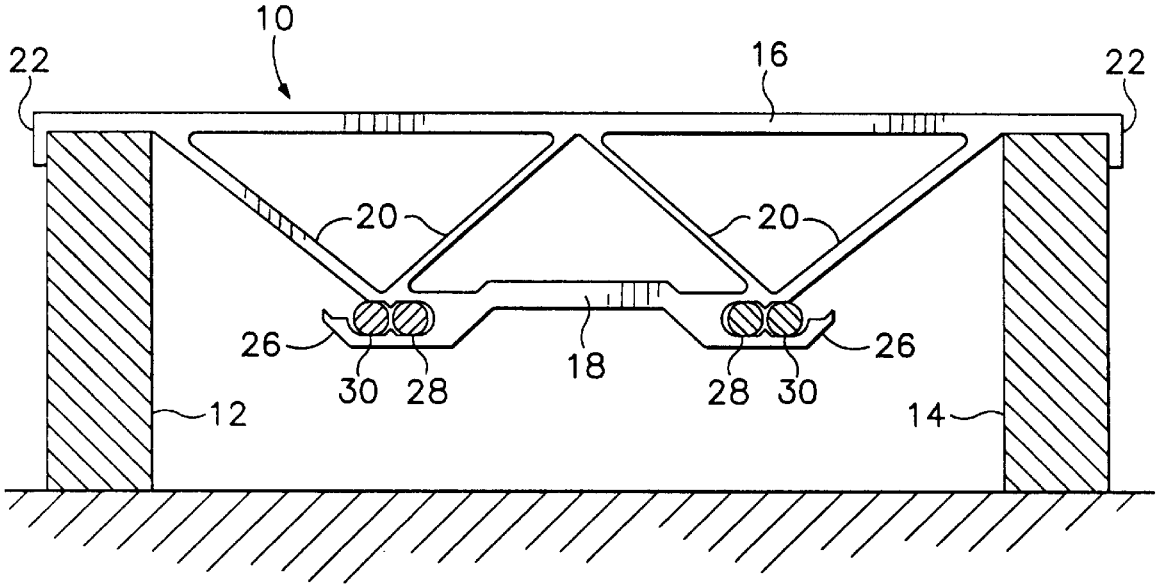
FIG. 4 is a vertical section taken along the line 4—4 in FIG. 3.

The outer opposite ends of top frame member 16 are turned downward to provide abutments 22. As shown in FIG. 4, the space between each abutment and the juncture of the adjacent angular truss strut 20 with the top frame member 16 is configured to receive the upper edge of a horizontally extending concrete form wall 12 and 14. The abutments 22 thus serve to bear against and retain the concrete form walls in predetermined spaced apart relation.

Openings 24 in the top frame member 16 inwardly of each of the abutments 22 register with the top of an underlying wall 12 or 14 and each is configured to receive a nail, screw or other fastener (not shown) if it is considered desirable to secure the top frame member 16 positively to the concrete form wall.

In some instances the concrete form walls may be thinner than those illustrated, in which case the inner opening 24 of each pair is used for a nail or other fastener to secure the walls inwardly of the abutments 22 and more closely adjacent the struts 20. The abutments 22 thus are not employed to abut the outer sides of the form walls, but rather the fasteners in the inner openings 24 secure the form walls in predetermined spaced apart condition.

The horizontal bottom member 18 mounts a pair of laterally spaced rebar support members 26. In the embodiment illustrated, the support members are in the form of open loops or clips 26 of U-shape profile, with the opening preferably facing laterally outward. Each of these clips is configured to removably receive and retain end portions of a pair of lengths of structural rebar 28 and 30 (FIGS. 3 and 4) arranged to extend horizontally in opposite directions from the clip. The rebar serves to provide reinforcement for concrete filled into the volume between the spaced concrete form walls 12 and 14. The ends of the rebar opposite those supported by each clip 26 are supported by another spacer 10' located an appropriate distance along the length of the concrete form.

Figure 5:
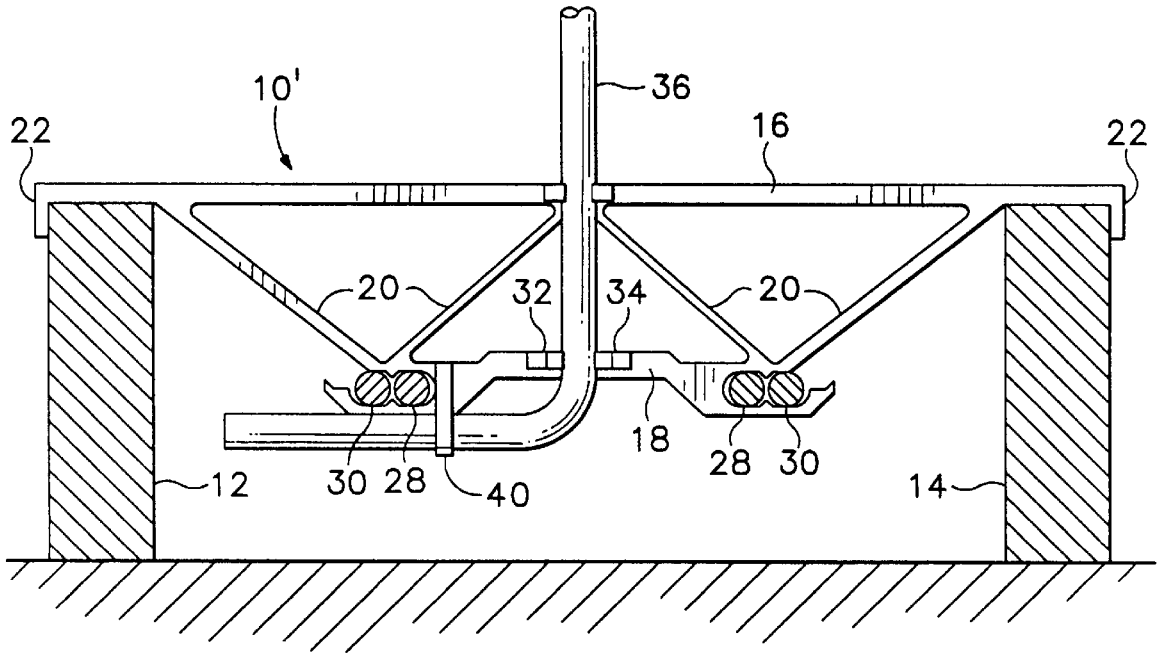
FIG. 5 is a vertical section taken along the line 5—5 in FIG. 3.

The framework of spacer 10' shown in FIG. 5 also mounts a pair of vertically spaced and registering rebar supports 32 and 34 for securing a length of rebar 36 removably in vertical position extending upward into a concrete wall form (not shown) projecting vertically upward from the horizontal concrete footing form. The supports preferably are formed as spaced resilient fingers 32 and 34 which receive rebar between them and resiliently grip the rebar to retain it in desired position.

The bottom end portion 36' of the rebar 36 may be bent 90° and the bent portion extended through the retainer opening 38 formed in tab 40 joining the horizontal bottom member 18. The bent portion 36' and opening 38 assist the supports 32 and 34 in maintaining the rebar 36 in vertical position. The vertical rebar 36 provides a structural tie between the horizontal concrete footing and the vertical concrete wall.

Referring to FIG. 3, the spacer 10' cooperates with spacer 10 in supporting the ends of horizontal rebar 28 and 30 opposite the ends supported by spacer 10. The spacer 10 is similar to spacer 10' in general construction, but does not include the vertical rebar supports 32 and 34 and retainer opening 38, since vertical rebar may not be required at the end of each length of horizontal rebar. The spacer 10 thus may be thinner than the spacer 10' since it only functions to maintain the spacing between the concrete form walls and in supporting the lapping ends of horizontal rebar. The spacer 10 may be formed by extrusion of synthetic resin and subsequently cut into narrow sections, or by injection molding or alternative methods.

In use, the spacer of this invention is installed at spaced intervals along the length of a pair of concrete form walls 12 and 14. If vertical rebar reinforcement is not required, spacers 10 may be utilized throughout, and they are spaced apart at distances determined by the lengths of the horizontal rebar 28 and 30, to support the opposite ends of the rebar. If desired, nails or other fasteners may be inserted through openings 24 in the top frame member and secured to the form walls to retain them in predetermined spaced apart condition prior to the pouring of concrete into the spacer between the walls.

When vertical rebar 36 is to be installed at spaced intervals to connect the concrete footing between walls 12 and 14 with a concrete vertical wall formed between spaced vertical form walls, a spacer 10' is interposed between spacers 10 at the desired intervals of vertical rebar. A length of rebar 36 then is extended through vertically registering supports 32 and 34 which grip the rebar resiliently and hold it in vertical position. If the bottom end portion of the rebar is bent 900, the bent portion is extended into the opening 38 and the vertical portion of the rebar is snapped through the spaced fingers 32 and 34.

Figure 6:
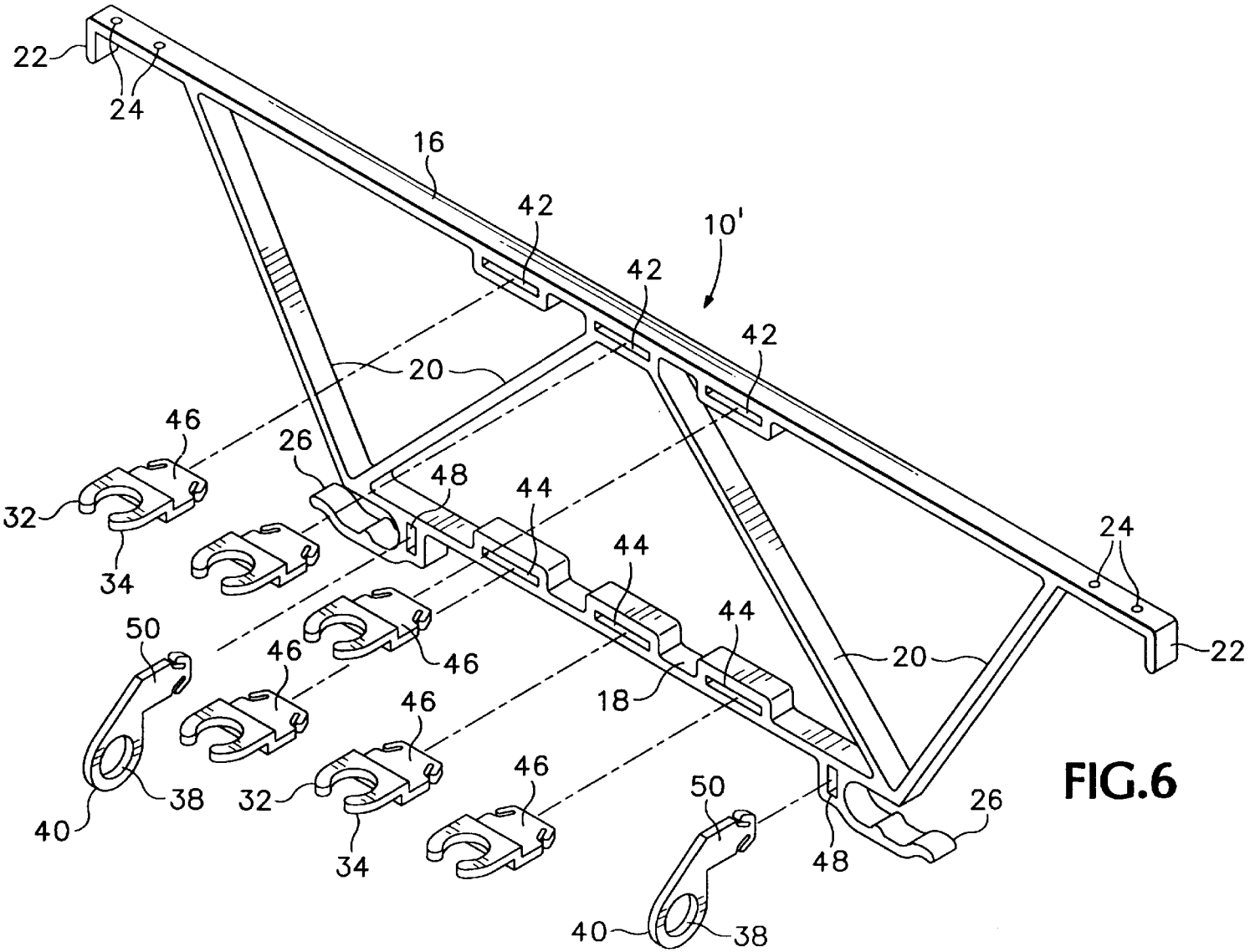
FIG. 6 is an exploded perspective view of a second configuration of concrete form wall spacer embodying the features of this invention.
Figure 7:
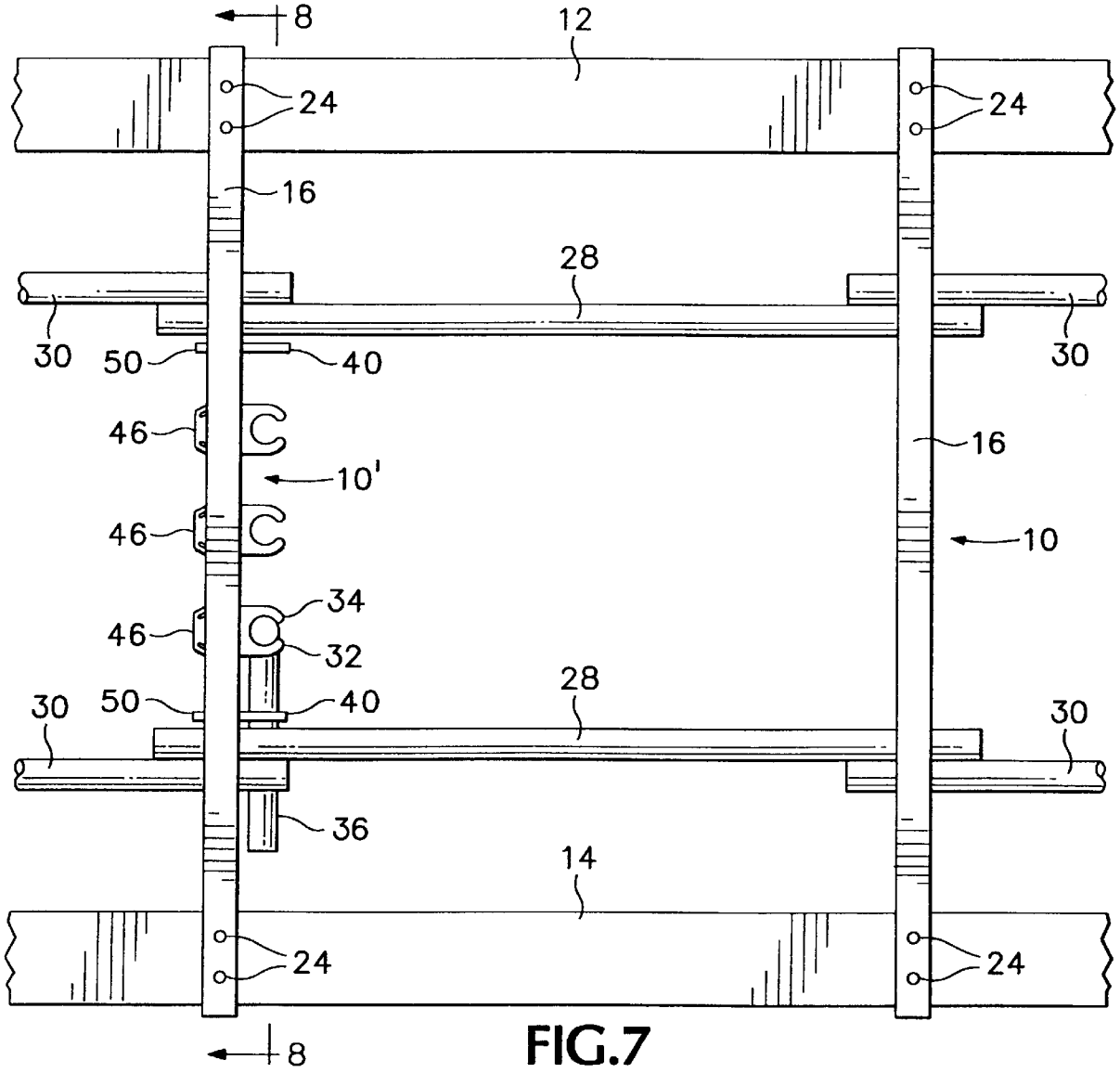
FIG. 7 is a fragmentary plan view showing the concrete form wall spacer of FIG. 6 in operative association with a pair of spaced concrete form walls and supporting vertical and horizontal rebars.
Figure 8:
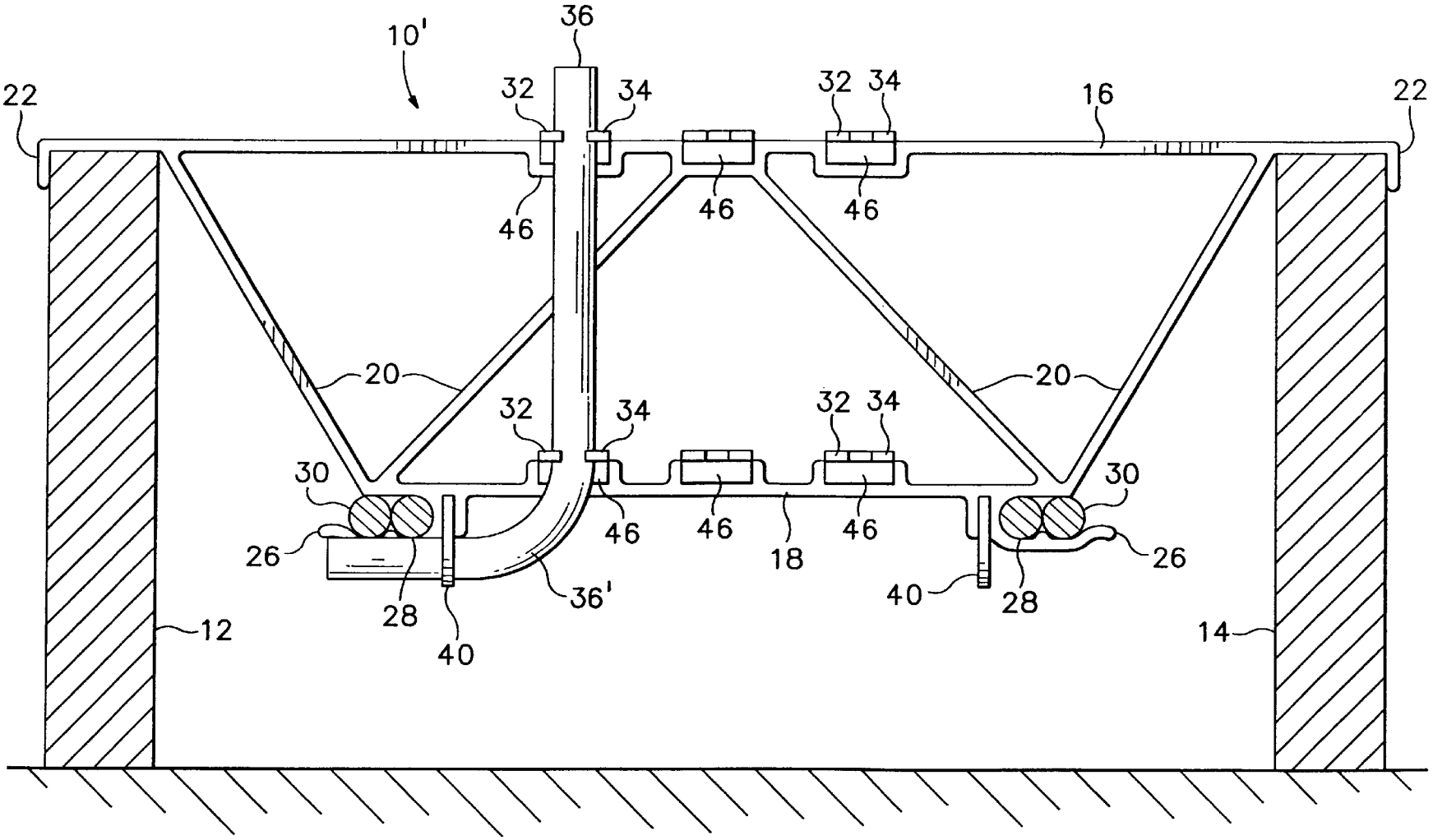
FIG. 8 is a vertical section taken on the line 8—8 in FIG. 7.

FIGS. 6, 7 and 8 illustrate a second embodiment of concrete form wall spacer of this invention which accommodates the support of one or a plurality of vertical rebar, as required for specific installations. Thus, three laterally spaced socket members 42 are provided on the underside of top frame member 16 and three cooperating socket members 44 are provided on the upper side of bottom frame member 18, in vertical alignment with socket members 42. In the embodiment illustrated, the socket members 42 and 44 are formed integrally with the spacer 10' by the extrusion of synthetic resin.

The socket members 42 and 44 are configured to removably receive the connector sections 46 of rebar support fingers 32 and 34. FIG. 6 shows the individual units of connector sections 46 and attached support fingers 32 and 34 detached from the socket members 42 and 44, while FIGS. 7 and 8 show them secured in the socket members and one vertical rebar 36 secured in one vertically aligned pair of fingers 32 and 34.

The embodiment of FIGS. 6, 7 and 8 also provides for supporting the bent end portion 36' of a rebar 36. Accordingly, a socket member 48 is provided adjacent the inner side of each of the clips 26 for removably receiving the connector section 50 of a tab 40 for an opening 38. Thus, two tabs 40 with openings 38 may be secured adjacent the laterally spaced clips 26 for supporting the bent end portions 36' of two vertical rebars 36. One of the vertical rebars 36 may be secured by the support fingers 32 and 34 located either at the vertically aligned central pair of socket members 42 and 44 or at a vertically aligned end pair of socket members.

It is to be noted that the spacers of FIGS. 1 and 6 may be produced by the extrusion of synthetic resin, with the detachable components of FIG. 6 provided by other technique. The spacer of FIG. 2 also may be produced by extrusion of synthetic resin, with the projecting components 32, 34 and 40 provided separately and then attached by adhesive, solvent, heat or other suitable bonding technique.

With the concrete form walls 12 and 14 secured in desired spaced apart position, concrete is poured into the space between the form walls to the upper edge thereof and allowed to cure. The spacers of this invention are embedded in the concrete and thus form an integral part of the concrete footing.

It will be apparent to those skilled in the art that various changes may be made in the size, shape, type, number and arrangement of components of the spacer described hereinbefore. For example, a single clip 26 or more than the two illustrated, may be provided when additional horizontal rebar is needed in the footing. The spacer may be made of various materials, such as metal or wood, but it preferably is formed by the molding of synthetic resin. The foregoing and other changes may be made, as desired, without departing from the spirit of this invention and the scope of the appended claims.

I claim:

1. In combination with a pair of concrete form walls spaced apart to contain concrete therebetween, a spacer securing the concrete form walls in predetermined spaced apart relation, the spacer comprising:

a) a framework having paralled top and bottom frame members, the top frame member spanning the space between the spaced apart form walls and resting upon the upper edges of said walls, b) means on the top frame member securing the form walls to said top frame member and fixing the predetermined spacing of said walls, and c) rebar support means on the framework for supporting rebar in position extending horizontally below the top frame member and below the upper edges of said form walls.

2. The combination of claim 1 including angularly disposed strut members forming a structural truss interconnecting the top and bottom frame members.

3. The combination of claim 1 wherein the form walls securing means includes at least one opening extending vertically through the top frame member adjacent each end thereof for receiving therethrough a fastener member configured to penetrate and secure the underlying top edge of the concrete form wall.

4. The combination of claim 1 wherein the form walls securing means includes downwardly extending abutment members on the outer ends of the top frame member for abutment by the form walls to define the maximum spacing between the form walls.

5. The combination of claim 1 wherein the rebar support means comprises a loop member configured to receive therein the end portions of a pair of lengths of rebar for extension horizontally therefrom in opposite directions.

6. The combination of claim 1 wherein the rebar support means comprises an open ended clip member configured to receive and retain therein the end portions of a pair of lengths of rebar for extension horizontally therefrom in opposite directions.

7. The combination of claim 1 including second rebar support means on the framework for supporting rebar in position projecting vertically upward from a lower end below the top frame member to an upper end extending above the top frame member, to provide a reinforcing interconnection between vertically disposed concrete walls.

8. The combination of claim 7 wherein the second rebar support means comprises a pair of resilient finger members arranged to receive therebetween and resiliently grip a vertically disposed length of rebar.

9. The combination of claim 7 wherein the second rebar support means is mounted detachably on the framework.

10. The combination of claim 7 wherein the second rebar support means includes a pair of rebar support members mounted detachably on the top and bottom frame members in vertical alignment.

11. The combination of claim 7 including a rebar-receiving opening on the framework arranged to removably receive a bent end portion of a length of vertically extending rebar supported by the second rebar support means.

12. The combination of claim 7 including a connector member having therein a rebar-receiving opening arranged to removably receive a bent end portion of a length of vertically extending rebar supported by the second rebar support means, and engagement means on the framework for detachably securing the connector member to the framework.

* * * * *